US005630740A

United States Patent [19]

Lavorata

[11] Patent Number: 5,630,740

[45] Date of Patent: May 20, 1997

[54] DEVICE FOR SURVIVAL AT SEA

[75] Inventor: Marc Lavorata, Paris, France

[73] Assignee: Zodiac International, Paris, France

[21] Appl. No.: 621,584

[22] Filed: Mar. 26, 1996

[30] Foreign Application Priority Data

Mar. 31, 1995 [FR] France ..... 95 03824

[51] Int. Cl.[6] ..... B63B 35/58

[52] U.S. Cl. ..... 441/42

[58] Field of Search ..... 441/40, 41, 42, 441/32; 244/149

[56] References Cited

U.S. PATENT DOCUMENTS 3,782,413 1/1974 Chacko ..... 441/41

4,441,639 4/1984 Craw et al. ..... 244/149

5,342,230 8/1994 Louis ..... 441/42

*Primary Examiner*—Jesus D. Sotelo

*Attorney, Agent, or Firm*—Larson and Taylor

[57] ABSTRACT

A device (1) for survival at sea, comprising a pneumatic raft (2) or the like in the uninflated and folded state, together with at least one reservoir (3) of inflation fluid, which raft and reservoir are enclosed in a rigid container (4), the device being characterized in that the container (4) includes a hatch (9), and in that the reservoir of inflation fluid (3) is provided with at least one sensor (10) for detecting at least one magnitude characteristic of the state of the fluid contained in the reservoir, in particular its pressure and/or its temperature, and is organized in such a manner that said detected magnitude can be measured through the open hatch of the container, thereby enabling the state of the survival device to be inspected without opening the container.

7 Claims, 1 Drawing Sheet

DEVICE FOR SURVIVAL AT SEA

Figure 1:
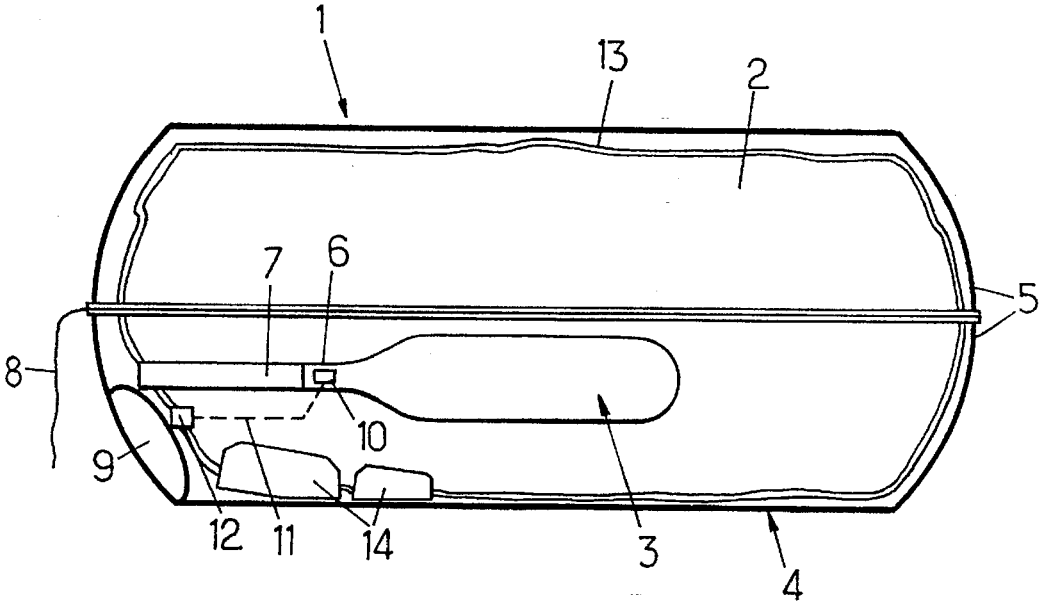

The present invention relates to improvements provided to devices for survival at sea, of the type comprising a pneumatic raft or the like in the uninflated and folded state together with at least one reservoir of inflation fluid, all enclosed in a rigid container.

In order to be certain that survival devices are permanently ready for immediate use, such devices are subject to regular periodic inspections which, at present, are performed annually. Inspection requires the survival device to be taken from its storage location on board a ship and to be transferred to an approved maintenance station on land. Inspection may consist, in particular, in opening the container to verify its operating state, in inflating the raft to verify that it is airtight, in inspecting the inflation fluid reservoir(s) and proper sealing thereof by weighing the fluid, in inspecting the stores, and optionally in replacing stores, in particular perishable stores that have been damaged or that have reached an end-of-validity date.

Such periodic inspections are lengthy, expensive, and restricting, and it is desired, in particular by users, for the periodicity of such full inspections to be considerably lengthened, but without thereby lowering the degree of operating safety of survival devices.

A particular object of the invention is to provide an original disposition for a device for survival at sea of the type mentioned in the preamble that makes it possible to space out the periodicity of full inspections while nevertheless making it possible for intermediate spot inspections to be performed on the essential members and/or on perishable materials having a lifetime shorter than the periodicity of the main inspections.

To this end, according to the invention, a survival device as mentioned in the preamble is essentially characterized in that the container includes a hatch giving access to its inside volume and in that the inflation fluid reservoir(s) is provided with at least one sensor for detecting at least one magnitude that is characteristic of the state of the fluid contained in the reservoir, in particular its pressure and/or its temperature, and is organized in such a manner that said detected magnitude can be measured from the open hatch of the container.

By means of such a disposition, it is possible to inspect the state of the inflation fluid without there being any need to extract the reservoir(s) from the container, and thus without there being any need to open the container.

In order to facilitate such inspection, provision may indeed be made for the reservoir(s) to be itself fitted with appropriate measurement members and/or couplings for direct connection to inspection devices, and for it to be situated for this purpose immediately behind the access hatch. However, in order to provide it with maximum protection against corrosion, provision is made in the context of the present invention for the uninflated and folded pneumatic raft and the inflation fluid reservoir(s) to be enclosed in a flexible bag that is closed in watertight manner so as to further increase the effectiveness of the protection of the raft and of the reservoir against moisture and corrosion: this slows deterioration of these two elements, thereby making it possible significantly to increase the intervals between successive inspections, which may, for example, be increased to three years or five years.

Under such conditions, provision is made for the sensor to be connected via a link element to a connector that is accessible through the open hatch, thereby making it possible to connect said connector to external measuring instrument. Since the uninflated raft and the reservoir(s) are also enclosed in a watertight bag, it is possible to ensure that the connector is of the type that passes through the wall and that is fixed to the watertight bag, in which case the connector is located on a portion of the watertight bag that is situated in the immediate proximity of the hatch; to avoid the problem of making a sealed connection through the bag, it is also possible to ensure that the bag surrounds in sealed manner a closure head for the reservoir(s), which head then remains outside said bag, in which case the link element is connected to the head of the reservoir(s) with the connector being situated close to the hatch.

In order also to make it possible to take full advantage of having the hatch, it is possible to ensure that at least one other watertight flexible bag is provided that encloses perishable stores. Thus, still without opening the container, it is possible, during intermediate inspections, to gain access to bags containing perishable stores and to extract them from the container for inspection purposes and/or replacement purposes.

Because of the various dispositions of the invention, it is possible to have a survival device that is suitable for inspection and maintenance at short intervals (e.g. annually) with respect to some of its elements (inspection of the inflation fluid, inspection and/or replacement of perishable stores), with such short interval inspections being performable via the hatch and without opening the container. Under such circumstances, there is no longer any need for the container to be unshipped, and all the above inspection can be performed on board the ship while the container remains on its stowage support. As for inspection of the raft itself and inspection of the physical state of the reservoir and/or replacement thereof, which require the container to be unshipped and taken to a land-based maintenance station, the presence of the watertight bag lining the container proper makes it possible for such operations to be widely spaced apart. Thus, by the disposition of the invention, a container is provided having greatly simplified maintenance conditions, thus making them cheaper and less restricting, while nevertheless retaining the same level of safety.

Figure 2:
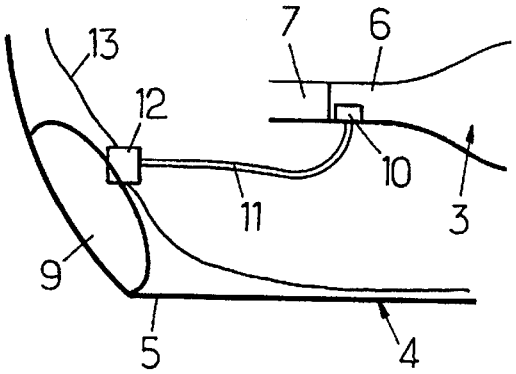
Figure 3:
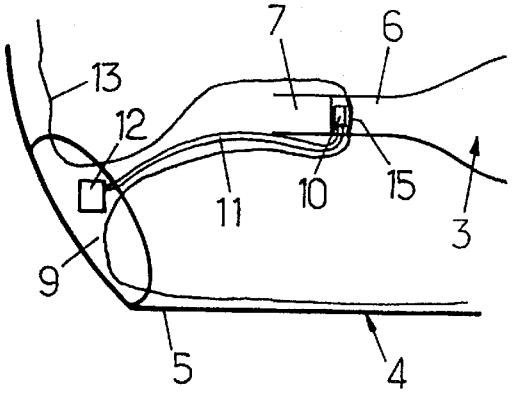

The invention will be better understood on reading the following description of certain preferred embodiments, given solely as non-limiting examples. In the description, reference is made to the accompanying drawing, in which:

FIG. 1 is a diagrammatic view of a device for survival at sea that is implemented in accordance with the invention, the container being represented highly diagrammatically and being shown as though it were transparent so that its contents is visible; and FIGS. 2 and 3 are views on a larger scale respectively showing two variant organizations for a portion of the FIG. 1 device.

With reference initially to FIG. 1, a device for survival at sea, given overall reference numeral 1, essentially comprises a pneumatic raft 2 or the like in the uninflated and folded state, together with at least one reservoir 3 of inflation fluid ($CO_2$ and $N_2$, for example) which are enclosed in a rigid container 4 that is generally constituted by two half-shells 5 that are assembled together in a manner that is proof against bad weather conditions at sea.

The reservoir 3 has a reservoir closure head 6 with members for sealed closure that are suitable for delivering the inflation gas, and a trigger head 7 for starting the inflation process, said trigger head itself being capable of being actuated by an external actuator member 8.

The container 4 is provided with a closure hatch 9 that is preferably disposed on the bottom half-shell 5 and at one end thereof so as to facilitate handling of the hatch and access to the inside of the container when the container is stowed in its support cradle on board a ship.

The reservoir 3 is fitted with at least one sensor 10 for detecting at least one magnitude or parameter that is characteristic of the state of the inflation fluid contained inside the reservoir. The sensor 10 is preferably disposed in the head 6 of the reservoir and, for example, it serves to determine the pressure and/or the temperature of the fluid. In addition, the organization is such that said detected magnitude can be measured from the open hatch 9.

One very simple solution would be to fit the head 6 of the reservoir directly with one or more instruments (pressure gauge, thermometer) and to dispose the reservoir in such a manner that the head 6 is situated immediately behind the hatch so that the instruments can be read directly through the open hatch. Nevertheless, certain constraints on the device specific to organizing and folding a life raft within a container (the reservoir being enveloped as completely as possible within the sheet material of the uninflated raft, plus various other dispositions mentioned below) mean that firstly the reservoir is not easily disposed within the container so that its head is situated in the vicinity of the hatch 9, and secondly that physical access to the reservoir is not possible.

Provision may thus be made to connect the sensor 10 via a link element represented diagrammatically by numeral 11 to a connection element or connector 12 which is, itself, situated immediately behind the hatch 9 and to which a measurement and/or detection instrument can be connected via the open hatch 9. Such organization is very flexible as to the nature of the sensor 10, the nature of the link element 11, and the nature of the connector 12. In particular, the sensor 10 may be a mere branch connection, while the link element 11 may be a flexible hose and the connector 12 may be a fluid connector having a closure valve which may be connected to an external instrument including all the necessary detection, conversion, measurement, and display members. Similarly, the sensor 10 may be organized to deliver an electrical signal representative of the measured magnitude (temperature, pressure, . . .), with the link element 11 being an electrical line (suitable for connection to a plurality of sensors) and with the connector 12 being an electrical connector to which an external instrument can be connected that is organized to process the signals received and to display the information obtained therefrom.

To increase protection of the folded raft 2 and of the reservoir 3, provision is made to enclose them in a flexible watertight protective bag 13 which is itself enclosed inside the container 4, said watertight bag 13 optionally also including non-perishable stores. Perishable stores (food, pharmaceuticals, batteries, . . .) may be enclosed in one or more auxiliary flexible bags 14 which are then disposed close to the hatch 9 so as to be capable of being extracted via said hatch for inspection and/or replacement purposes at a periodicity that is shorter than the periodicity with which the raft and the reservoir contained in the main bag 13 are inspected.

Under such circumstances, as shown in FIG. 2, the connector 12 may be of the through connector type which is mounted in sealed manner on a portion of the flexible bag 13 that is situated close to the hatch 9. The link element 11 then extends inside the bag 13.

To avoid making use of a through connector type of connector, which is expensive, provision may alternatively be made, as shown in FIG. 3, for the flexible bag 13 to have an opening 15 that surrounds the head 6 of the reservoir in sealed manner, by means of an O-ring. Thus, the reservoir 3 can remain enveloped within the folds of the uninflated raft material with the link element 11 extending between the folds of the bag 13 while remaining outside the bag 13.

Naturally, and as can be seen from the above, the invention is not limited in any way to the particular application and embodiment described in detail; on the contrary, the invention extends to any variants thereof.

I claim:

1. A device for survival at sea comprising a pneumatic raft in the uninflated and folded state, together with at least one reservoir of inflation fluid, which raft and reservoir are enclosed in a unitary compartment of a rigid container, the device being characterized in that unitary compartment of the container includes a hatch, and in that the reservoir of inflation fluid is provided with at least one sensor for detecting at least one magnitude characteristic of the state of the fluid contained in the reservoir and is organized in such a manner that said detected magnitude can be measured from the open hatch of the container, whereby the state of the survival device can be inspected without opening the container.

2. A survival device according to claim 1, characterized in that the sensor is connected via a link element to a connector that is accessible via the open hatch, thereby making it possible to connect an external measuring instrument to said connector.

3. A survival device according to claim 2, characterized in that the connector is of the wall feedthrough type and is fixed through the watertight bag.

4. A survival device according to claim 2, characterized in that a bag surrounds in sealed manner a closure head of the reservoir which has at least a portion remaining outside said bag, and in that the link element is connected to the head of the reservoir.

5. A survival device according to claim 1, characterized in that the uninflated and folded pneumatic raft and the reservoir of inflation fluid are enclosed in a flexible bag that is closed in watertight manner.

6. A survival device according to claim 5, characterized in that the watertight bag also encloses non-perishable stores.

7. A survival device according to claim 5, characterized in that at least one other waterproof flexible bag is provided that encloses perishable stores.

* * * * *